United States Patent [19]

Noguez

[11] 4,277,423

[45] Jul. 7, 1981

[54] FUEL CALIBRATION DEVICE FOR CARBURETOR

[76] Inventor: Robert W. Noguez, 5660 NW. 78th Ave., Miami, Fla. 33166

[21] Appl. No.: 121,129

[22] Filed: Feb. 13, 1980

[51] Int. Cl.[3] ..... F02M 19/06

[52] U.S. Cl. ..... 261/34 R; 261/41 D; 261/71; 261/121 A

[58] Field of Search ..... 261/34 R, 121 A, 71, 261/41 D

[56] References Cited

U.S. PATENT DOCUMENTS

| | | | |
|---|---|---|---|
| 2,892,622 | 6/1959 | Goodyear | 261/34 R |
| 2,973,947 | 3/1961 | Sterner | 261/34 R |
| 3,409,277 | 11/1968 | Reise | 261/34 R |
| 3,807,707 | 4/1974 | Johnson | 261/34 R |
| 4,003,968 | 1/1977 | Rickert | 261/121 A |
| 4,052,490 | 10/1977 | Fedison | 261/71 |
| 4,100,663 | 7/1978 | Crum | 261/34 R |
| 4,205,024 | 5/1980 | Hirosawa | 261/34 R |

*Primary Examiner*—Tim R. Miles

*Attorney, Agent, or Firm*—Oltman and Flynn

[57] ABSTRACT

A fuel calibration device is provided for replacing the original metering device associated with the carburetor and the fuel bowl of an internal combustion engine to enable the various fuel flows to be adjusted and calibrated. The metering systems of the device are accessible for interchanging them. A plurality of different metering systems are made available and changes are made by selection of the desired metering system. Provisions are made for changing idle jets, idle air, main system jets, main system air and main system emulsion tube.

8 Claims, 11 Drawing Figures

FIG. 1
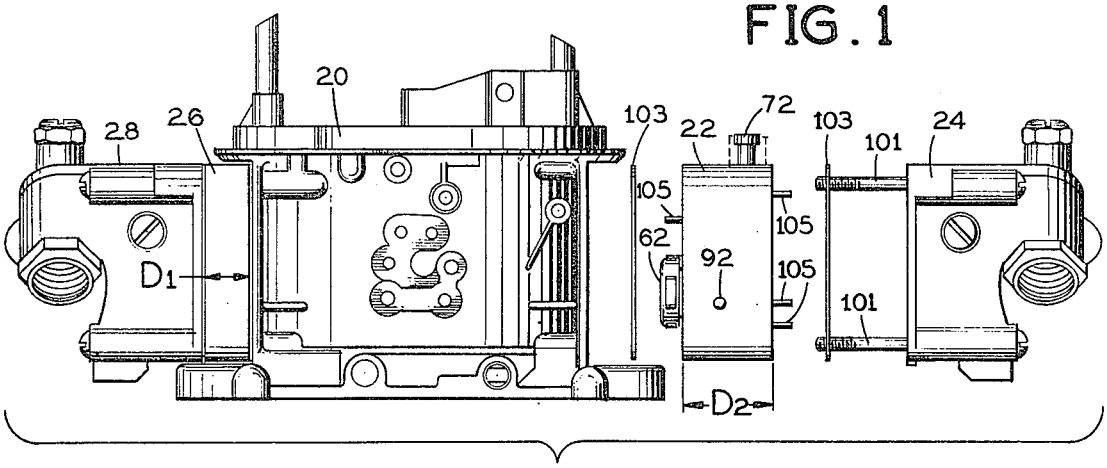
FIG. 2
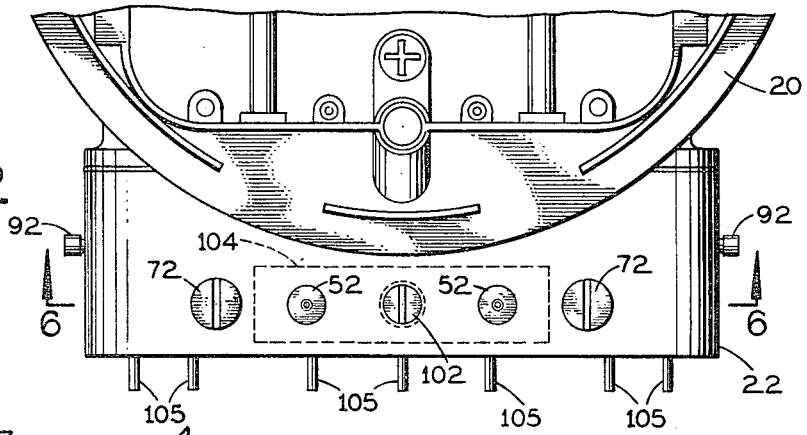
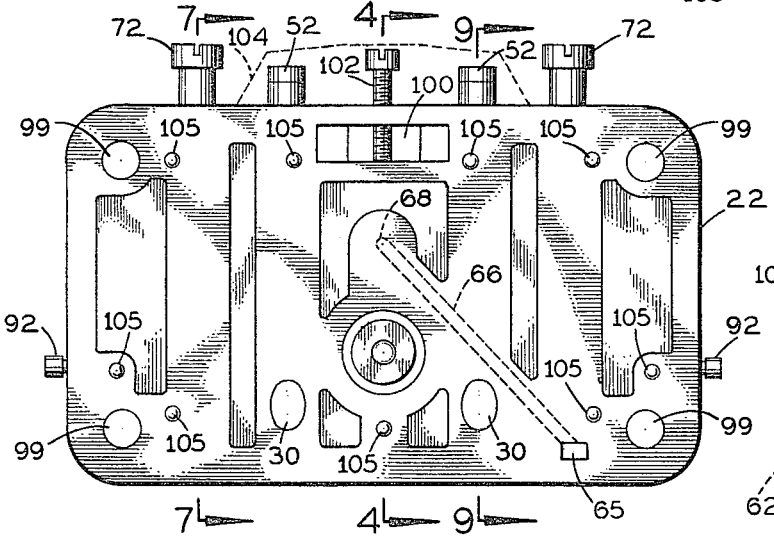
FIG. 3
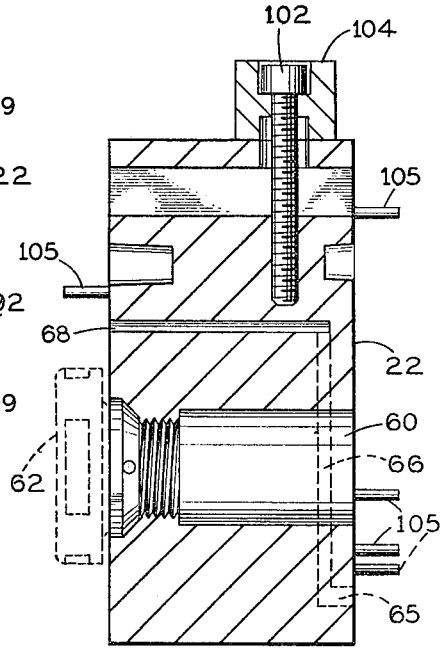
FIG. 4

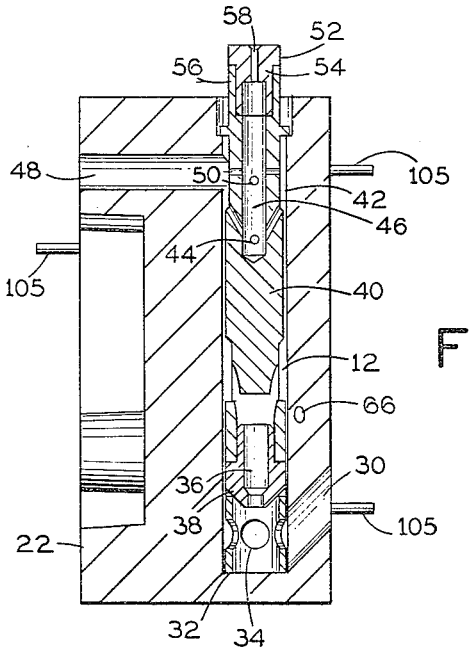
FIG. 9
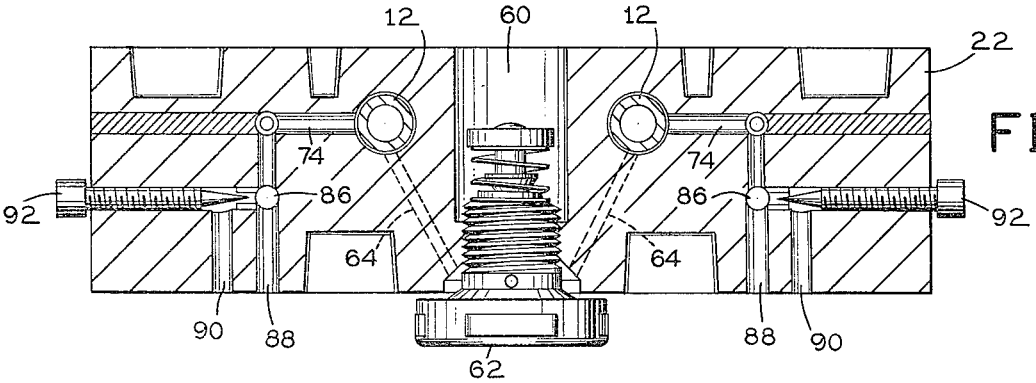
FIG. 10
FIG. 11
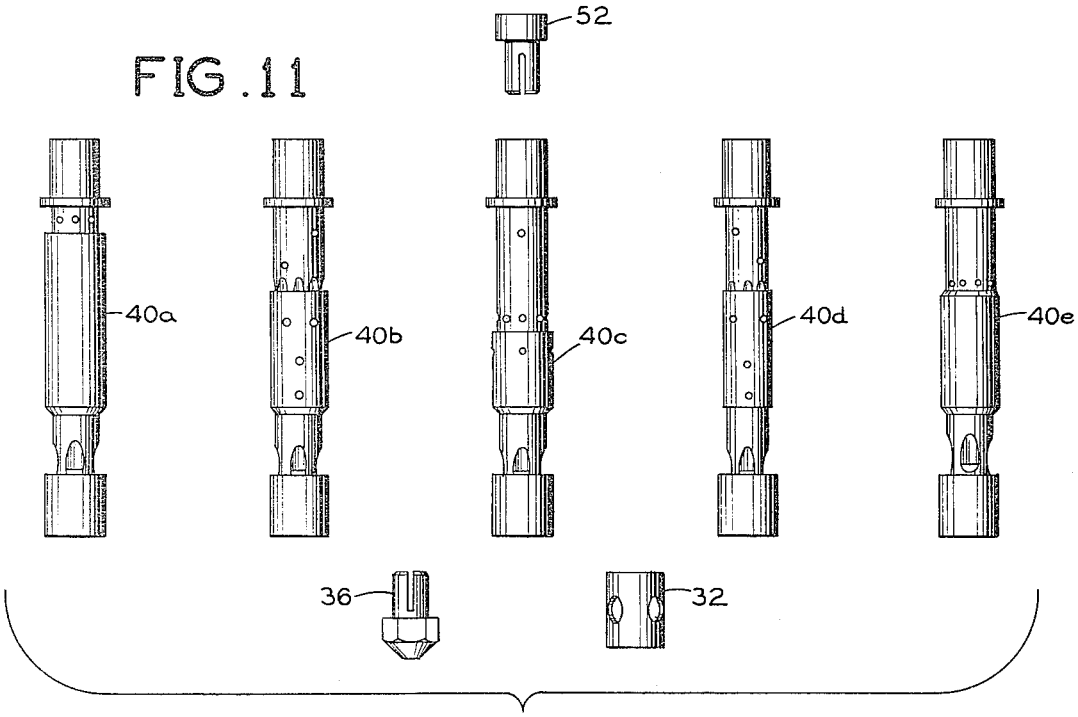

FUEL CALIBRATION DEVICE FOR CARBURETOR

BACKGROUND OF THE INVENTION

This invention relates to a fuel calibration device for replacing the original fuel metering device for a carburetor. Replacement fuel metering devices have been proposed for example in U.S. Pat. Nos. 3,807,707 and 4,100,663. The fuel insert plat of U.S. Pat. No. 3,807,707 is to be used in conjunction with the original metering block rather than as a substitute for it. The replacement of main jets in U.S. Pat. No. 4,100,663 is accomplished only after modifications are made to the existing fuel bowl, and such modifications are avoided in the present invention.

SUMMARY OF THE INVENTION

The fuel calibration device of the invention enables the user to calibrate or fix the various fuel flows necessary for proper engine performance and economy. The metering systems in the device are accessible unlike conventional metering devices. A plurality of different metering systems are made available, and by selection from the available components, the desired calibration is achieved. The resulting fuel calibration device is fully compatible with the conventional carburetor and conventional fuel bowl and can be installed without modifying them in any way.

Accordingly, it is an object of the invention to replace a conventional fuel metering device for a carburetor of an internal combustion engine with a fuel calibration device to enable the user to calibrate the fuel flows to the engine.

Another object of the invention is to make provisions in the device for changing and balancing idle jets and idle air.

A further object of the invention is to make provisions in the device for changing and balancing main system jets, main system air, and main system emulsion tubes.

Another object of the invention is to enable the user to install the fuel calibration device without modifying the carburetor or the fuel bowl in any way.

Other objects of this invention will appear from the following description and appended claims, reference being had to the accompanying drawings forming a part of this specification wherein like reference characters designate corresponding parts in the several views.

BRIEF DESCRIPTION OF DRAWINGS

FIG. 1 is an elevational view of an assembly including a carburetor, a fuel calibration block, and a fuel bowl in accordance with one embodiment of the invention;

FIG. 2 is a fragmentary plan view of a portion of the carburetor together with the fuel calibration block;

FIG. 3 is an elevational view of the rear side of the fuel calibration block;

FIG. 4 is a sectional view taken along line 4—4 of FIG. 3;

FIG. 9 is a sectional view taken along line 9—9 of FIG. 3;

FIG. 10 is a sectional view taken along line 10—10 of FIG. 5; and

FIG. 11 is a composite view showing several assemblies, each consisting of a main jet, emulsion tube and air corrector.

Other objects of this invention will appear from the following description and appended claims, reference being had to the accompanying drawings forming a part of this specification wherein like reference characters designate corresponding parts in the several views.

DETAILED DESCRIPTION

Figure 5:
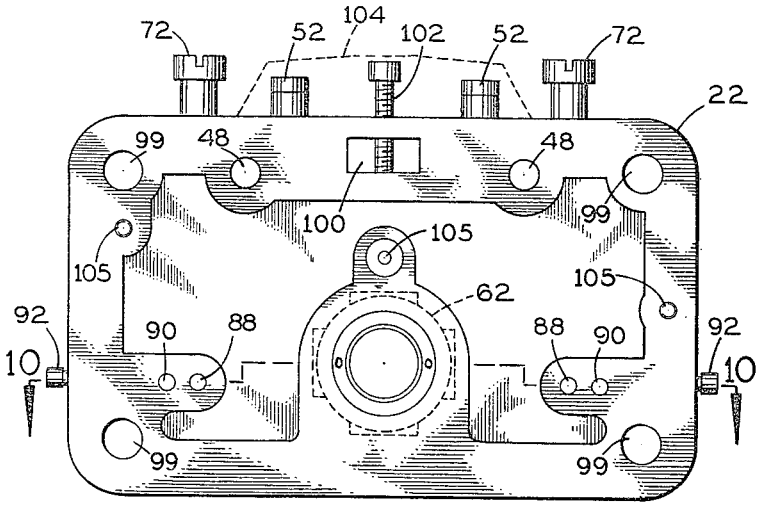
FIG. 5 is an elevational view of the front side of the fuel calibration block.

In FIG. 1, the carburetor 20 is assembled on its right side with a fuel calibration block 22 and a conventional fuel bowl 24. On the other side of the carburetor, there is shown a conventional metering block 26 attached to the carburetor between the carburetor and another conventional fuel bowl 28. It will be understood that the fuel calibration block 22 replaces the conventional metering block 26. Thus, in a complete assembly, there will be two fuel calibration blocks 22 on either side of the carburetor instead of just one as illustrated in FIG. 1. The purpose of showing one fuel calibration block in FIG. 1 is to illustrate that the fuel calibration block may be substituted directly for the metering block of a conventional assembly without changing any portion of the assembly.

The fuel calibration block 22 enables the user to calibrate the various fuel flows necessary for proper engine performance and economy. The fuel calibration block gives access to critical metering systems and affords complete adjustability. The invention enables the idle system to be adjusted by means of adjusting the idle fuel jet size and the idle air bleed size. The main fuel metering system may be adjusted by means of main jet size, emulsion tube characteristics, and air bleed size.

The fuel calibration block 22 can be installed with no modifications to the conventional carburetor body and conventional fuel bowl body. The fuel calibration block can be installed with the originally designed gaskets. No special tools are required. The fuel calibration block can be utilized without modification of the existing air cleaners, velocity stacks or air funnelling devices. The jets and calibrating devices can be removed through the use of an ordinary screw driver. It is not necessary to remove the carburetor from the engine manifold in the process of such removal. Any component except the power valve which will be described can be removed without disassembling the system of FIG. 1.

Referring to FIG. 9, the fuel calibration block 22 includes a fuel inlet 30 through which fuel can enter the main well 12. It will be understood that the block 22 includes two of these main wells, each receiving a combination main jet, emulsion tube and air corrector system.

Fuel entering inlet 30 enters the main well 12 at its bottom and enters seat 32 through openings 34. The fuel passes through passage 36 within a main jet 38 which is attached directly to an emulsion body 40. Emulsion body 40 has a very slight clearance within the well 12 so that fuel can pass around the outside of the emulsion body 40 to reach the space 42 near the top of the well 12. The air enters through openings 44 into the cavity 46 inside the emulsion body 40, and from there passes through passage 48 to the carburetor. Openings 50 connect the cavity 46 with the passage 48.

An air corrector 52 is attached to the emulsion body 40 at its top. The air corrector 52 includes a reduced portion 54 which fits inside the tubular portion 56 of the emulsion body. An air bleed opening 58 allows air to enter through the air corrector 52 into the cavity 46 inside the tubular portion 56 of the emulsion body 40. This air mixes with the fuel and passes with it through passage 48 into the carburetor.

The emulsion body serves to convert the liquid fuel passing from the main jet 38 into a much lighter froth-like fuel-air mixture. The advantages of converting the liquid to this frothy form are that it makes for easier vaporization of the fuel and it reduces the viscosity of the fuel-air mixture which allows it to respond much more quickly to the vacuum signal produced in the discharge venturi of the carburetor. By selecting the placement and number and nominal size opening of the air mixing holes and varying the diameter and length of the emulsion body, different characteristics can be imparted to the fuel-air mixture. The emulsion body having the above-mentioned characteristics can exercise a great deal of influence on the liquid fuel that will pass around it. The emulsion body will act:

(1) as an air vent to satisfy the initial vacuum signal;

(2) and later to act as an air nozzle for mixing the air with the fuel; and (3) the relative height of the air nozzle will also affect the lifting rate of the fuel main wells.

The air corrector 52 serves a multitude of functions in its association with the emulsion body 40 and the main jet 38. First of all, as the bleed or passage for the air, the nominal size and subsequent flow is greatly affected by the surrounding air pressure. The air pressure at any given moment can be influenced by weather conditions or geographic considerations such as altitude.

As a strong vacuum signal is produced in the main discharge venturi of the carburetor, the air bleed 58 will initially try to bleed off or satisfy the vacuum demand. As the signal continues to increase and fuel is pulled up from the main well, the air entering the air bleed 58 will mix with the fuel.

The main air bleed system affects the entire range of the main system operation, but the higher revolutions per minute range of engine operation will be more affected by the selection of the main air bleed 58 size.

The method for allowing air correction changes employed in this invention provides the user both the tools in the sense of having a large selection of jets to choose from and the means in the sense of having a fuel calibration block designed to facilitate such interchanging of jets. Alternate jets, emulsion bodies, and air correctors are shown in FIG. 11. Each of the emulsion bodies 40A, 40B, 40C, 40D, and 40E may be selected for use in the fuel calibration block 22. Each of these emulsion bodies is used with an air corrector 52, a seat 32, and a main jet 36. By providing for such selection, the invention greatly increases the range of characteristics for the carburetor.

Fuel can also be introduced into the main well 12 by passing through the power circuit which will subsequently affect the main system mixture. The power circuit includes an opening 60 extending through the fuel calibration block 22, and a conventional power valve 62 located in the passage 60 for controlling the flow of fuel from the fuel float through the passage 60. When the valve 62 is opened, it allows fuel to pass through passages 64 to the main wells 12 (FIG. 10). Fuel passing through passages 64 so as to be introduced into the main wells 12 increases the amount of fuel originally metered by the main jets 36, and this increased fuel will also be acted upon by the structural characteristics of the emulsion body 40 and the air corrector 52. The mixture is allowed to pass through passage 48 into the main carburetor 20.

The discharge from the accelerator pump of the fuel bowl enters the fuel calibration block 22 at opening 65 (FIG. 4) and passes through a transfer passage 66 to a discharge passage 68 from which it enters the main carburetor 20.

Figure 7:
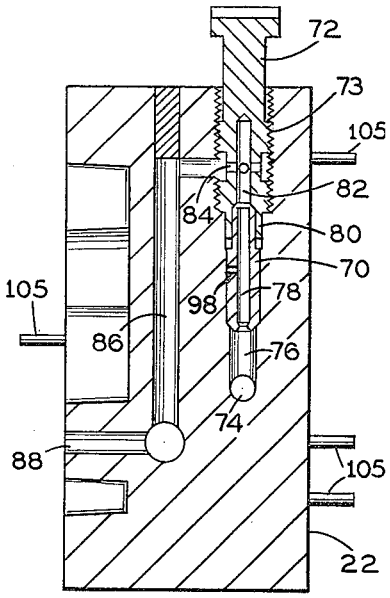
FIG. 7 is a sectional view taken along line 7—7 of FIG. 3.

The tubular idle jet 70 (FIG. 7), which is positioned by a holder 72 that is threaded at 73 and screwed into block 22, provides metering of fuel transferred from the main fuel well 12 through passages 74. These are two identical idling systems. The fuel flows up through bore 76 and then through a vertical opening 78 extending through idling jet 70. The upper end of tubular idling jet 70 is received within the lower end 80 of tubular holder 72. The fuel is received within a cavity 82 within holder 72. From this cavity, the fuel flows through a discharge opening 84 into an idling passage 86 with an idling discharge 88 which leads into the carburetor 20. Subsequent flow from discharge 88 to another discharge 90 (FIG. 10) is controlled by an idle adjustment screw 92 received in the fuel calibration block 22.

Idle bleed air passes through openings 94 (FIG. 6) and from there through passage 96 to the bore 76 in which the jet 70 is received. This air enters the inside passage 78 within jet 70 through holes 98 so as to mix with the fuel inside jet 70 and continue through holder 72, passage 86 and discharge 88 into the carburetor.

Figure 6:
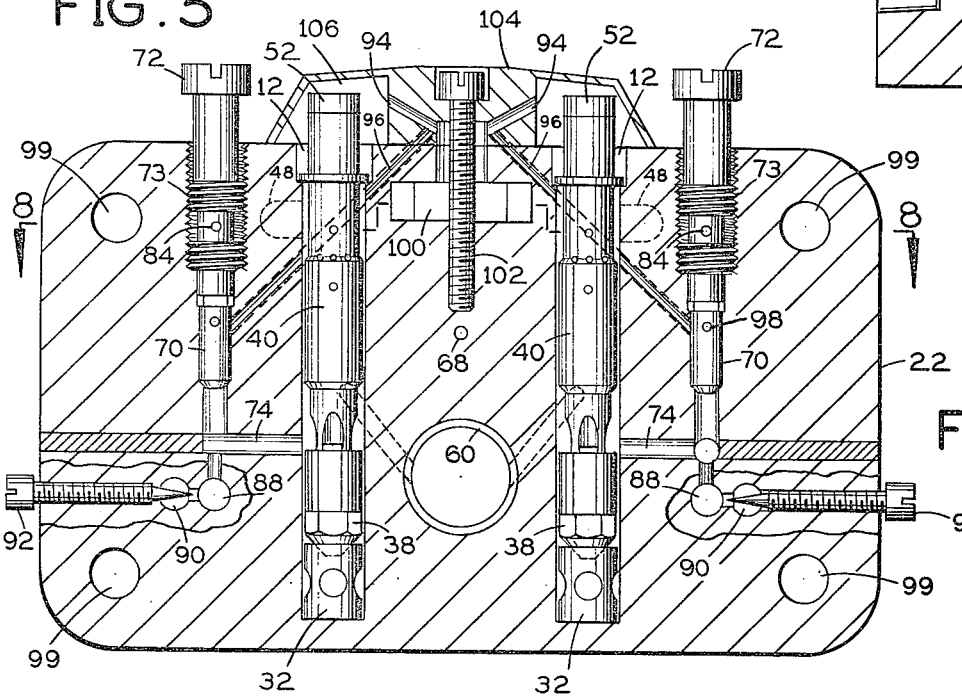
FIG. 6 is a sectional view taken along line 6—6 of FIG. 2.
Figure 8:
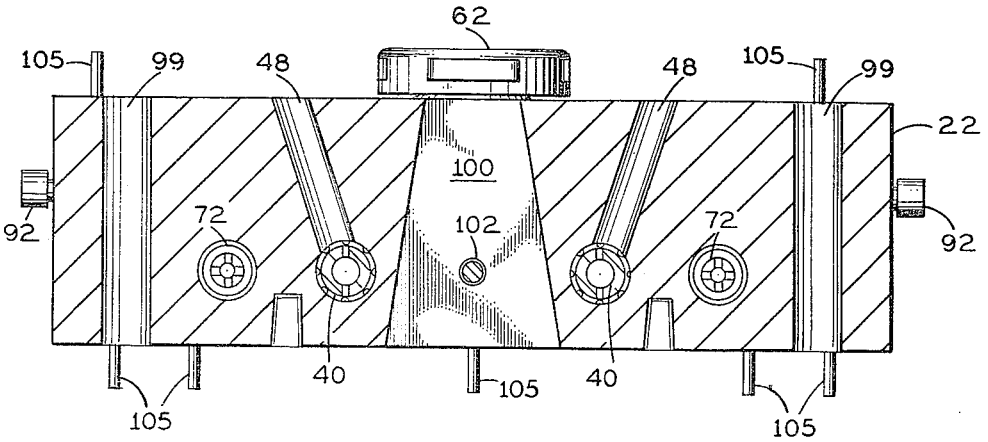
FIG. 8 is a sectional view taken along line 8—8 of FIG. 6.

Referring specifically to FIG. 6, air passage 100 communicates with the standard fuel bowl vent opening and provides the passage of bleed air for the idle and main system air correction devices. Bleed air is collected around the outside of the holddown screw for the air cap 104. Air flows from passage 100 through openings 94 into the inside space 106 within the air cap 104. This air can reach the air corrector bleed openings 58, and can also flow through the passages 96 into the idle jets 70.

When the carburetor is operating under curb idle conditions, the idle jet 70 must provide the proper amount of fuel to allow the engine 50 idle under very high vacuum conditions and with a relative low mixture velocity. Curb idle conditions are achieved when fuel is flowing through discharge 90.

Progressive idle conditions are achieved when increasing engine revolutions per minute from an idling condition to part throttle or cruising conditions. The progressive system must provide the engine with an increased amount of fuel to satisfy power requirements. Progressive idle conditions are achieved by fuel flowing through discharge 88.

In association with the idle jet 70, the idle air bleed 96 allows for a fine tuning of the curb idle and transfer system. Proper idle fuel jet and air bleed size selection is important for many reasons. If a too large a jet is being used, fuel accumulation in the intake manifold can occur causing poor performance, reduced fuel mileage and increased emission problems. The jet is interchangeable with other jets of different sizes. The idling systems and main systems may be removed and interchanged with related systems by using only a screwdriver.

Openings 99 receive bolts 101 for assembling the fuel calibration block 22 with the carburetor 20. The original gaskets 103 are used. Pins 105 facilitate assembly. The main assemblies 38, 40, 52 may be held in the main wells 12 by the cover 104, or by threaded plugs, or by other suitable means.

I claim:

1. A fuel calibration device for use with a carburetor and fuel bowl of an internal combustion engine to calibrate fuel flow, comprising:

block means for receiving fuel metering systems;

means forming a main well in said block means;

main jet means received in said main well for metering main fuel flow;

emulsion tube means received in said main well above said jet means for emulsifying fuel with air;

air corrector means received in said main well above said emulsion tube means for introducing air into the fuel at said emulsion tube means;

said main jet means and said emulsion tube means and said air corrector means being united in a main assembly that is removable from said main well when said block means is attached to said carburetor to permit replacement with a like main assembly having different characteristics;

means forming an idle system well in said block means;

idle jet means received in said idle system well for metering idle fuel flow;

and holder means received in said idle system well above said idle jet means;

air bleed means for metering and introducing air into the idle fuel flow;

said idle jet means and said holder means being united in an idle assembly that is removable from said idle system well when said block means is attached to said carburetor to permit replacement with a like idle assembly having different characteristics;

supply means for supplying fuel to said wells;

and discharge means for discharging fuel and air from said wells to the carburetor.

2. A fuel calibration device according to claim 1 in which said supply means includes:

a first fuel inlet leading to said main well means;

and a second fuel inlet leading to said main well means including a valve.

3. A fuel calibration device according to claim 2 in which said supply means further includes:

a first passage leading from said main well to said idle system well for supplying fuel thereto.

4. A fuel calibration device according to claim 3 in which said air bleed means includes:

a second passage leading from the exterior of said block means to said idle jet means.

5. A fuel calibration device according to claim 4 including:

removable cap means for covering the entrance of said air bleed means into said block means.

6. A fuel calibration device according to claim 5 in which:

said air corrector means is located under said cap means.

7. A fuel calibration device according to claim 3 in which:

said discharge means includes a discharge outlet from said idle system well having an adjustable valve.

8. A fuel calibration device according to claim 7 in which:

said discharge means includes a further discharge outlet from said idle system well.

* * * * *